US007401479B2

(12) United States Patent
Fields

(10) Patent No.: US 7,401,479 B2
(45) Date of Patent: Jul. 22, 2008

(54) ACCESSORY BASKET FOR A WASHING MACHINE

(76) Inventor: Maryann Angela Fields, 3021 W. Tanager Ct., Lecanto, FL (US) 34461

( * ) Notice: Subject to any disclaimer, the term of this patent is extended or adjusted under 35 U.S.C. 154(b) by 391 days.

(21) Appl. No.: 11/113,006

(22) Filed: Oct. 5, 2005

(65) Prior Publication Data

US 2007/0074544 A1 Apr. 5, 2007

(51) Int. Cl.
*D06F 39/00* (2006.01)
*D06F 37/12* (2006.01)
*D06F 37/18* (2006.01)

(52) U.S. Cl. ..... 68/4; 68/23 R; 68/235 R; 68/237; 211/163; 211/181.1

(58) Field of Classification Search ..... 68/4, 68/23 R, 133, 235 R, 237; 211/162, 181.1
See application file for complete search history.

(56) References Cited

U.S. PATENT DOCUMENTS 1,579,569 A * 4/1926 Sherrick ..... 220/488
1,793,798 A * 2/1931 Harker ..... 134/121
2,151,354 A * 3/1939 Osuch ..... 134/182
2,345,185 A * 3/1944 Edgar ..... 239/221
2,563,046 A * 8/1951 Killin ..... 68/23 R
3,145,551 A * 8/1964 Ziegler ..... 68/4
3,673,823 A * 7/1972 Gakhar ..... 68/12.19
4,175,409 A * 11/1979 Morey ..... 68/4
4,637,230 A * 1/1987 Roberts ..... 68/4
5,546,771 A * 8/1996 Bonar ..... 68/4

* cited by examiner

*Primary Examiner*—Joseph L. Perrin

(57) ABSTRACT

An accessory basket for a washing machine includes a substantially cylindrical basket member having a bottom end with a centrally disposed aperture thereon. A plurality of slots radially extend from the aperture allowing the basket to be placed over a washing machine agitator. The top end of the basket is open allowing accessory articles such a shoes to be placed within the basket. A lid a placed over the top end of the basket to secure the accessory items therein. Accordingly, operation of the washing machine will result in the articles being shifted about within the basket thereby minimizing noise and damage to the washing machine or article.

5 Claims, 1 Drawing Sheet

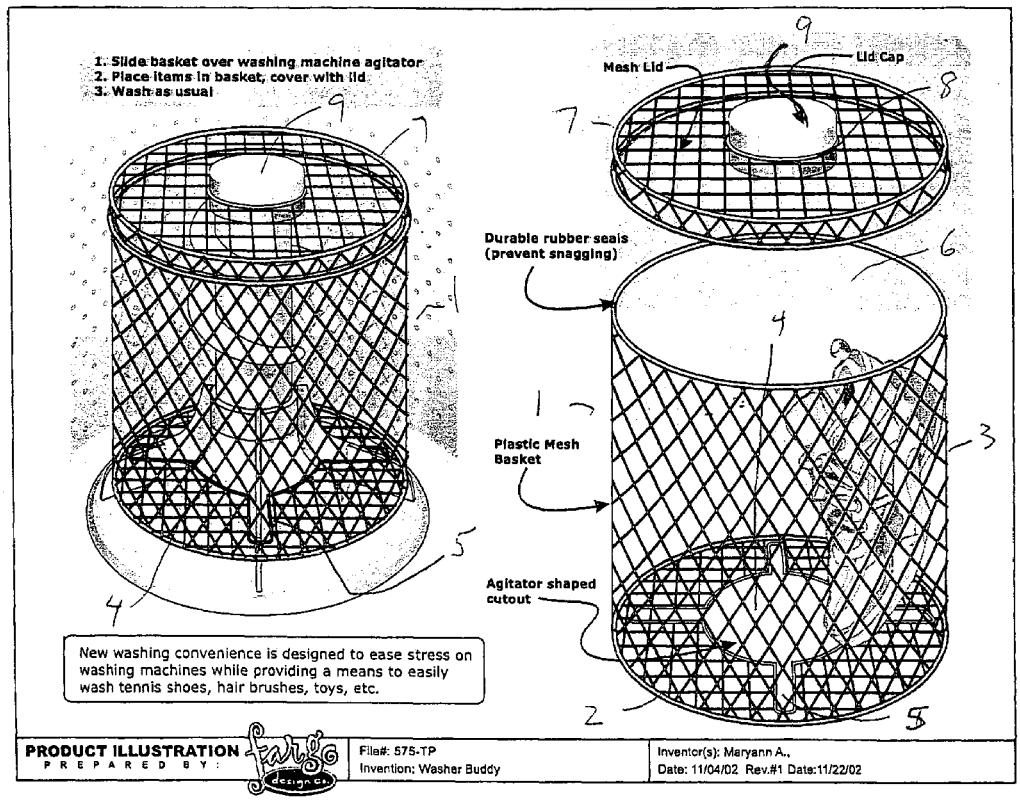

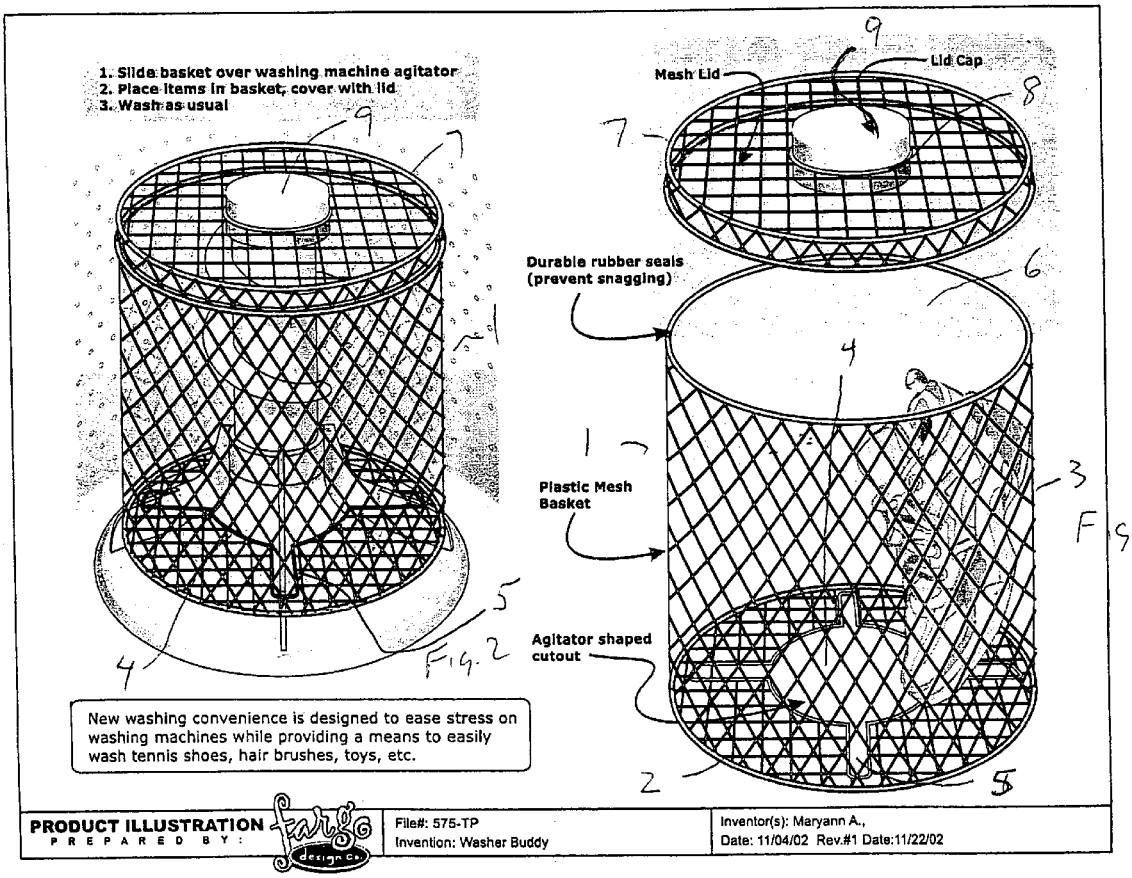
1. Slide basket over washing machine agitator
2. Place items in basket, cover with lid
3. Wash as usual
Mesh Lid
Lid Cap
Durable rubber seals (prevent snagging)
Plastic Mesh Basket
Agitator shaped cutout
Fig. 1
Fig. 2
New washing convenience is designed to ease stress on washing machines while providing a means to easily wash tennis shoes, hair brushes, toys, etc.
PRODUCT ILLUSTRATION PREPARED BY:
Fargo design co.
File#: 575-TP
Invention: Washer Buddy
Inventor(s): Maryann A.,
Date: 11/04/02 Rev.#1 Date:11/22/02

ACCESSORY BASKET FOR A WASHING MACHINE

BACKGROUND OF THE INVENTION

The present invention relates to a uniquely configured basket that is installed in a washing machine cleaning chamber for safely and quietly cleaning bulky or heavy items such as shoes.

DESCRIPTION OF THE PRIOR ART

Cleaning shoes, toys and other similar bulky or heavy objects in a washing machine has always been problematic. Typically, the washing machine agitator will continuously knock the item about the cleaning chamber possibly damaging the washing machine or the item. Furthermore, because such items are constantly colliding with the cleaning chamber wall, the wash cycle is noisy and irritating. The present invention addresses this problem by providing a uniquely configured basket for insertion into a washing machine cleaning chamber for safely and quietly retaining heavier articles such as shoes.

SUMMARY OF THE INVENTION

The present invention relates to an accessory basket for a washing machine. The device comprises a substantially cylindrical mesh basket having a circular bottom end with a continuous cylindrical wall upwardly extending therefrom. The bottom end includes a centrally disposed aperture with slots radially extending therefrom. The top end of the basket is open and is in communication with an interior article compartment. A mesh lid is securable over the open top.

To use the above described device, the basket is placed over the agitator with the agitator shaft received within the aperture on the bottom end of the basket and each agitator blade protruding through one of the slots assuring that the agitator can freely rotate. Shoes or other heavy items are placed into the interior compartment and the lid is tightly secured over the open top. Accordingly, as the agitator is reciprocated, the articles will be moved about the basket interior minimizing or eliminating noise and any damage to the article or washing machine.

It is therefore an object of the present invention to provide a device that eliminates the disadvantages associated with washing heavy items in a washing machine.

It is another object of the present invention to provide a device that allows a user to safely place a heavy or bulky article into a washing machine.

It is yet another object of the present invention to provide an accessory basket for a washing machine that can be quickly and conveniently installed.

Other objects, features, and advantages of the present invention will become readily apparent from the following detailed description of the preferred embodiment when considered with the attached drawings and the appended claims.

BRIEF DESCRIPTION OF THE DRAWINGS

FIG. 1 is a perspective, slightly exploded view of the accessory basket.

FIG. 2 is a perspective view of the accessory basket secured about the washing machine agitator.

DESCRIPTION OF THE PREFERRED EMBODIMENT

The present invention relates to an accessory basket for a washing machine. The device comprises a substantially cylindrical mesh basket 1 having a circular bottom end 2 with a continuous cylindrical wall 3 upwardly extending therefrom. The bottom end includes a centrally disposed aperture 4 with slots 5 radially extending therefrom. The top end of the basket 6 is open and is in communication with an interior article compartment. A mesh lid 7 is securable over the open top. The lid contains a central opening 8 with a hollow cap 9 positioned therein. A lower end of the cap is open for accommodating a top, distal end of a washing machine agitator shaft if necessary.

To use the above described device, the basket is placed over the agitator with the agitator shaft received within the aperture on the bottom end; the basket is lowered until each agitator blade completely protrudes through a respective slot assuring that the agitator can freely rotate within the basket interior compartment. Shoes or other heavy items are placed into the interior compartment and the lid is tightly secured over the open top end with the central cap superimposed on the distal end of the agitator shaft. Accordingly, as the agitator is reciprocated, the articles will be moved about the basket interior minimizing or eliminating noise as well as any damage to the article or the washing machine.

Preferably, the diameter of the basket is only slightly smaller than that of the washing machine cleaning chamber, though the diameter can be varied. Additionally, the size, shape and materials of construction of each of the components can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

I claim:

1. An accessory basket for a washing machine having an agitator comprising an agitator shaft with blades, the basket comprising:

a substantially cylindrical mesh basket having a circular bottom end with a continuous cylindrical wall upwardly extending therefrom and an open top end; and a mesh lid securable over the top of the basket;

wherein the bottom end of the basket includes a centrally disposed aperture with slots radially extending therefrom configured to receive the agitator shaft with blades such that each agitator blade protrudes through a respective slot causing the basket to rotate with the agitator.

2. The basket according to claim 1, wherein the mesh lid comprises a central opening with a hollow cap positioned therein configured to accommodate a distal end of the agitator shaft.

3. A washing machine comprising a cleaning chamber; an agitator rotatably disposed in the chamber, the agitator comprising an agitator shaft with blades and a basket configured to be placed over the agitator; wherein the basket comprises:

a substantially cylindrical mesh basket having a circular bottom end with a continuous cylindrical wall upwardly extending therefrom and an open top end; and wherein the bottom end includes a centrally disposed aperture with slots radially extending therefrom configured to receive the agitator shaft with blades such that each agitator blade protrudes through a respective slot causing the basket to rotate therewith during operation.

4. The washing machine according to claim 3, further comprising a mesh lid securable over the top of the basket.

5. The basket according to claim 4, wherein the mesh lid comprises a central opening with a hollow cap positioned therein configured to accommodate a distal end of the agitator shaft.

* * * * *